US005693143A

United States Patent [19]

Pham et al.

[11] Patent Number: 5,693,143

[45] Date of Patent: Dec. 2, 1997

[54] LIQUID OR POWDER COATING PRODUCT SPRAYER DEVICE FORMING AN OVERHEAD OR LATERAL MACHINE

[75] Inventors: Van Tan Pham, Grenoble; José Rodrigues, Crolles; Caryl Thome, Saint Egreve, all of France

[73] Assignee: Sames S.A., Meylan, France

[21] Appl. No.: 370,604

[22] Filed: Jan. 10, 1995

[51] Int. Cl.[6] ..... B05B 3/00

[52] U.S. Cl. ..... 118/323; 118/315; 118/324; 118/326

[58] Field of Search ..... 118/323, 313, 118/314, 315, 300, 326, DIG. 7; 55/DIG. 40

[56] References Cited

U.S. PATENT DOCUMENTS

| | | | |
|---|---|---|---|
| 2,083,634 | 6/1937 | Brackett | 118/316 |
| 3,415,131 | 12/1968 | Zieber | 74/31 |
| 4,323,030 | 4/1982 | Lehmann, Jr. | 118/309 |
| 4,882,881 | 11/1989 | Van Kuiken, Jr. et al. | 118/326 |
| 4,951,600 | 8/1990 | Soshi et al. | 118/696 |
| 5,092,307 | 3/1992 | Behr et al. | 118/315 |
| 5,259,879 | 11/1993 | Khattab et al. | 118/309 |
| 5,427,619 | 6/1995 | Ehinger et al. | 118/323 |

FOREIGN PATENT DOCUMENTS

| | | |
|---|---|---|
| 2131164 | 11/1972 | France . |
| 1334747 | 10/1973 | United Kingdom . |

OTHER PUBLICATIONS

Patent Abstracts of Japan: Ranzubaagu Ootomooteibu KK, Coating Device, Oct. 1992, vol. 16, No.254 (C-1000) & JP-A-04 197 465, Jul. 17, 1992—Abridgment.

*Primary Examiner*—Donald E. Czaja
*Assistant Examiner*—Calvin Padgett
*Attorney, Agent, or Firm*—Loeb & Loeb LLP

[57] ABSTRACT

A coating product sprayer device forms an overhead or lateral machine including a member carrying at least one sprayer mobile relative to objects to be coated and at least one lateral gantry carrying this member, which is adjustable in position in an opening in a front of the gantry. This member is moved up and down and/or with a lateral tracking movement by at least one coupling member such as a drive belt. At least one sealing panel closes off at least part of the opening and is fixed to one such flexible coupling member.

15 Claims, 4 Drawing Sheets

LIQUID OR POWDER COATING PRODUCT SPRAYER DEVICE FORMING AN OVERHEAD OR LATERAL MACHINE

BACKGROUND OF THE INVENTION

1. Field of the Invention

The invention concerns a liquid or powder coating product sprayer device forming an overhead or lateral machine. It is more particularly concerned with a drive system for the boom or the arm carrying at least one sprayer in a machine of this kind for upward and downward movement and for tracking lateral movement of the object to be coated.

2. Description of the Prior Art

In prior art overhead machines a boom is fastened to two box-sections by means of bearings allowing rotation of the boom about its major axis. The vertically mobile box-sections simply rest on gantries. This relatively complex structure requires very accurate dimensioning of the articulations of the boom/box-section/gantry assembly if flexing of the structure is to be avoided. The box-sections contain some drive components and extend the full length of lateral tracking of objects to be painted by the boom. They are heavy and bulky and seriously disrupt ventilation of the coating booth and therefore the quality of application. The dimensions of the box-sections depend on the travel of the boom, i.e. on parameters inherent to the object to be painted and/or to the system conveying these objects.

Driving the member carrying the sprayer(s) by means of wide flexible strips in the lateral gantry or gantries has previously been proposed. The strips constitute curtains covering substantially all of the width of the opening swept by the member carrying the sprayer(s).

The invention makes significant modifications to this type of system in order to improve its performance.

SUMMARY OF THE INVENTION

The invention consists in a coating product sprayer device forming an overhead or lateral machine including a member carrying at least one sprayer mobile relative to objects to be coated and at least one lateral gantry carrying said member, said member being adjustable in position in an opening in a front of said gantry, said member being moved up and down and/or with a lateral tracking movement by at least one coupling member such as a drive belt, and at least one sealing panel adapted to close off at least part of said opening being fixed to one such flexible coupling member.

The invention forms the or each drive belt into an almost complete loop inside the gantry without preventing access from the rear of the gantry to the carriage inside the latter and driving the member carrying the sprayer. All that is required is to avoid the sealing panel overlapping the drive belt near the counterweight opposite the carriage, which is not necessary since the counterweight is on the opposite side to the objects to be coated: there is no risk of the coating product crossing this free space. Tensioning the drive belt is facilitated by the presence of the counterweight, which makes the belt easier to drive.

If two drive belts are used extending laterally in a plane parallel to the path of the objects to be coated, it is possible to fasten the counterweight to both belts, which makes the assembly more stable and improves the driving of the belts.

Finally, the speed of displacement of the member carrying the sprayers is directly proportional to the speed of rotation of the drive motors because each drive belt forms a closed loop extending mainly along inside walls of the fixed gantry of said device that are substantially parallel to the path of the objects to be coated.

The invention will be better understood and other advantages of the invention will emerge more clearly from the following description of two embodiments of the coating product sprayer device of the invention given by way of example only and with reference to the appended drawings.

DETAILED DESCRIPTION OF THE INVENTION

Figure 1:
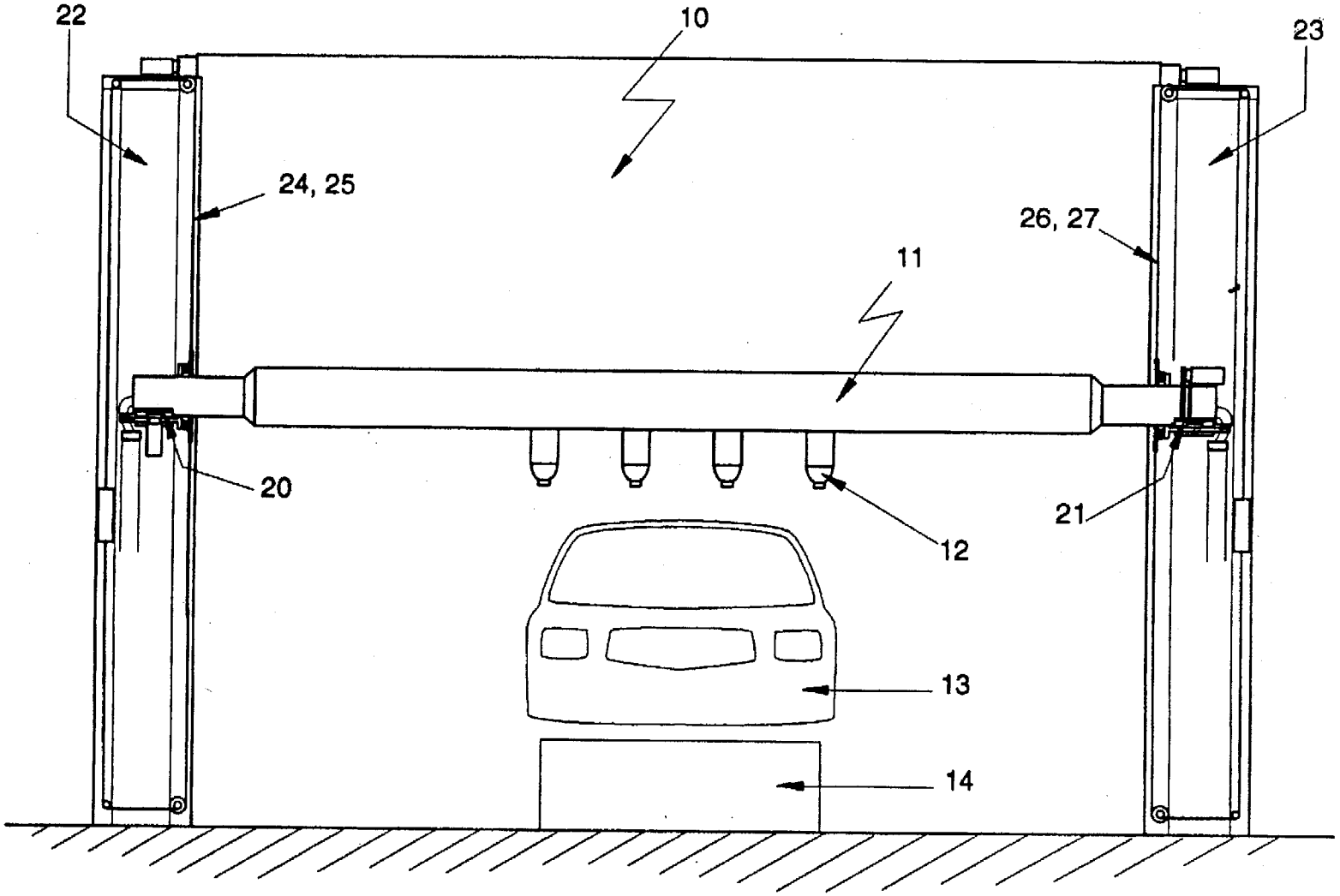
FIG. 1 is a diagrammatic perspective view of part of an overhead machine of the invention.

The overhead machine shown in FIG. 1 operates inside a spray booth 10 and includes a boom 11 carrying four sprayers 12 for applying a coating product to the horizontal front and rear parts of an object, for example an automobile vehicle body 13 carried by a conveyor 14.

The boom 11 is carried by two carriages 20 and 21 enabling it to be rotated and scanned between two gantries 22 and 23. The carriages are installed in the respective gantries where they are supported by flexible coupling members which in this example are drive belts 24, 25, 26 and 27. The boom can have a relatively small cross-section because it is easy to prevent it sagging despite the weight of the sprayers 12 by counterbalancing its ends. Its small cross-section minimizes disturbance of ventilation in the booth 10 near the sprayers 12.

Figure 2:
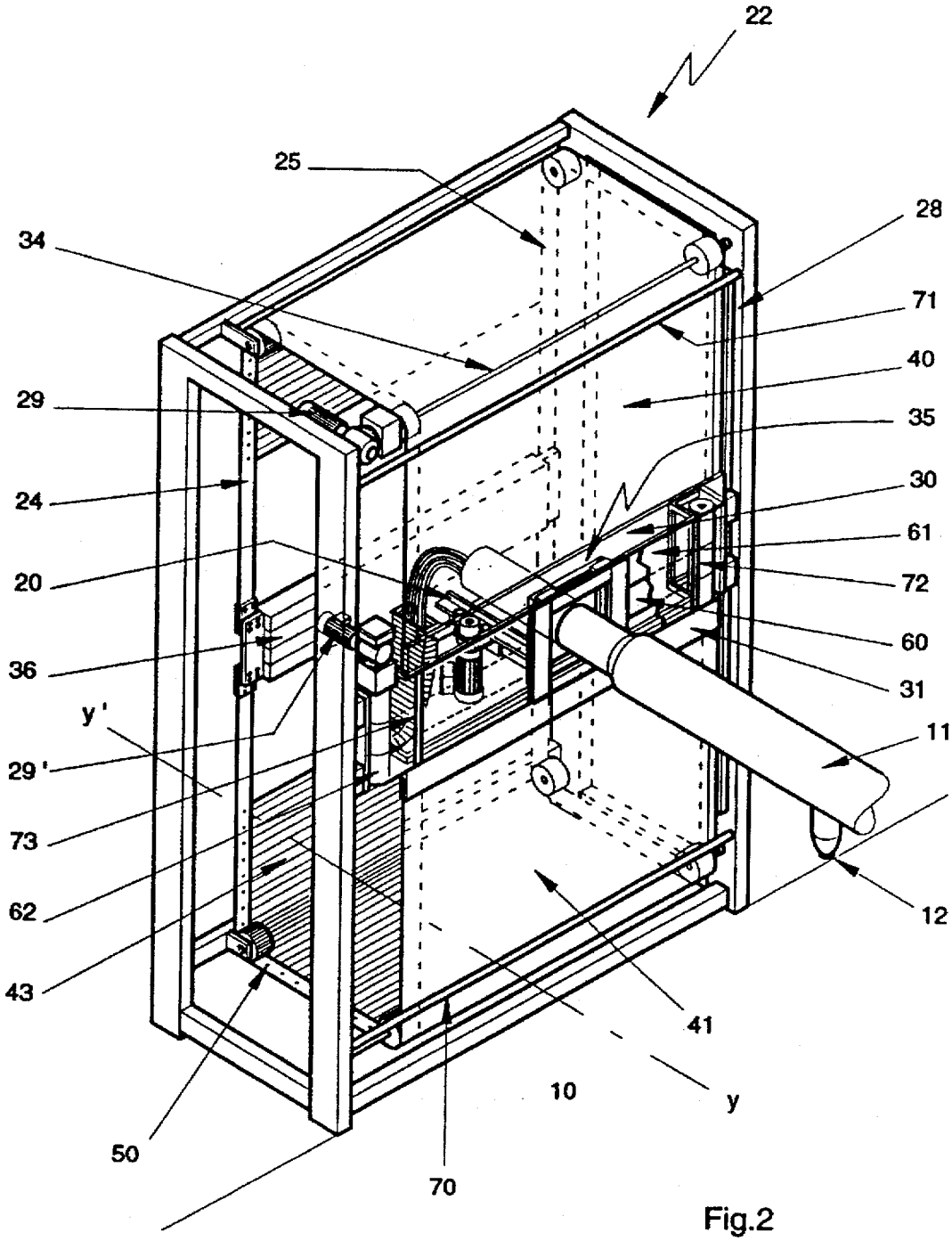
FIG. 2 is a diagrammatic perspective view of part of a gantry of an overhead machine of the invention.

FIG. 2 is a diagrammatic view of part of the gantry 22 and one end of the boom 11 carrying a sprayer 12. A front side of the gantry 22 incorporates an opening 28 across which the end of the boom 11 moves up and down and laterally to track the objects to be coated. The up and down and lateral tracking movements are driven by respective motors 29 and 29'. The motor 29 is attached to the gantry and the motor 29' is carried by the carriage 20.

The two drive belts 24 and 25 are narrow and strong and each forms a closed loop extending mainly along inside walls of the frame of the gantry that are substantially parallel to the path of the objects to be coated, i.e. the front, back, top and bottom walls, as their respective ends are attached to two parallel rails 30 and 31 on opposite sides of the carriage 20. The carriage 20 slides along these rails. A synchronization shaft 34 links the drive pulleys of the drive belts 24 and 25. They move the system 35 for lateral tracking of the objects 13 to be coated up and down. This system essentially comprises the rails and the carriage. A counterweight 36 is moved up and down on the rear side of the gantry 22. It is fixed substantially to the middle of the belts 24 and 25 which guarantees correct tensioning and balancing of the system because the belts 24 and 25 form closed loops and because the counterweight is fastened to both belts and therefore centered relative to the axis of symmetry YY' of the gantry 22. This stability prevents the belts or the system 35 jamming on up and down movement of the carriage 20.

Thanks to this positioning of the belts 24 and 25 the speed of vertical movement of the boom 11 can be controlled accurately by controlling the supply of electrical power to the motor 29. There is no belt around the motor drive shaft, which avoids variation in speed with the thickness of the belt already wound on.

The drive belts 24 and 25 are made from a material able to withstand the loads sustained. They can be notched belts.

Flexible sealing panels 40 and 41 made from a material resistant to the solvents used in the installation are fixed to the drive belts 24 and 25. The panels 40 and 41 have a surface area equal to that of the opening 28 that they close off. They therefore protect the interior of the booth and the belts 24 and 25 from splashing by the coating product. In particular, the drive belts 24 and 25 do not need to be made from a material resistant to the solvent as they are not in direct contact with the interior of the booth 10. The belts 24 and 25 and the system 30 are inside the gantry and are separated from the booth 10 by the flexible panels 40, 41.

The respective materials can be optimized by virtue of this dissociation of the drive function (the drive belts 24 and 25) and the sealing function (the panels 40 and 41).

On their rear side, i.e. the side facing towards the interior of the gantry 22, the sealing panels 40 and 41 can incorporate stiffener battens 43 parallel to the winding axes of the belts 24 and 25. This makes them rigid in the direction parallel to the path of the objects to be coated, which prevents them flapping and generating noise.

They are flexible in the other dimension, however, enabling them to follow the path of the belts 24 and 25 over part of their displacement at least. It is not necessary to wind the panels 40 and 41 on themselves when they are soiled with coating product. The rear side of the panels 40 and 41 remain clean at all times.

In an alternative embodiment of the invention that is not shown the panels 40 and 41 are made from an elastic material such as an elastomer, for example, and are tensioned between the belts 24 and 25. Because of the resulting prestressing they cannot flap or generate noise and the battens are superfluous.

In another advantageous embodiment of the invention the panels 40 and 41 are removably fixed to the belts 24 and 25, for example by means of rivets 50 or using a known system of cooperating claws and cloth loops. This makes it possible to change the panels. 40 and 41 either depending on how soiled they become or at regular intervals. They can be changed relatively quickly because it is not necessary to demount the carriage 20 or the system 35, which remain in place, supported by the drive belts 24 and 25.

The panels 40 and 41 provide a seal only for the front side of the gantry 22, i.e. the side facing the objects to be coated. The height of the panels 40 and 41 can be limited to provide a space on either side of the counterweight 36 for access to the carriage 20 from the rear of the gantry 22, i.e. from outside the booth.

An arrangement similar to that just described can be used to drive the system 35. A drive belt 60 coupled to the motor 29' and driving the carriage 20 is covered with two sealing panels 61 and 62 on opposite sides of the window through which the end of the boom 11 passes. Given the relatively small size of the panels 61 and 62, they are usually not stiffened by battens. The combination of the panels 40, 41, 61 and 62 forms part of the booth 10.

Sealing plates which are not shown to avoid overcomplicating the drawing and whose design will be evident to the person skilled in the art prevent particles of paint passing between the panels 40, 41, 61 and 62 and the edges of the opening 28. Also, the interior of the gantry 22 can be kept at a slightly raised pressure to prevent any contamination of the interior of the gantry. In this case the gantry is closed at the rear, for example by means of an additional door or by fixing the panels 40 and 41 to the belts 24 and 25 as far as the counterweight 36.

Cleaning means 70, 71, 72 and 73 are provided to prevent soiling of the sealing panels 40, 41, 61 and 62. In the case of a painting installation the cleaning means can comprise bars for depositing non-stick product and/or scrapers which rub at all times on the sealing panels, so that the panels can be cleaned even during spraying. In the case of a powder coating installation, the cleaning means may comprise suction strips in contact with the sealing panels which remove therefrom any particles of powder deposited thereon. These devices can also operate during spraying without impeding the movement of the sprayers. In both cases the panels can be moved to the maximal extent at regular intervals to enable the cleaning means to clean all of their surface. Similar means can naturally be provided on the carriages to clean the panels.

In one embodiment of the invention that is not shown the panels 40 and 41 are flexible and fastened to the belts 24 and 25 only near the rails 30 and 31. They are then pressed against the belts 24 and 25 at the front of the gantry but can move away from them when the belts 24 and 25 become horizontal where they join the rear side of the gantry. The panels can then follow a different path along the ceiling and along the floor of the installation where they are cleaned continuously by an appropriate system.

Figure 3:
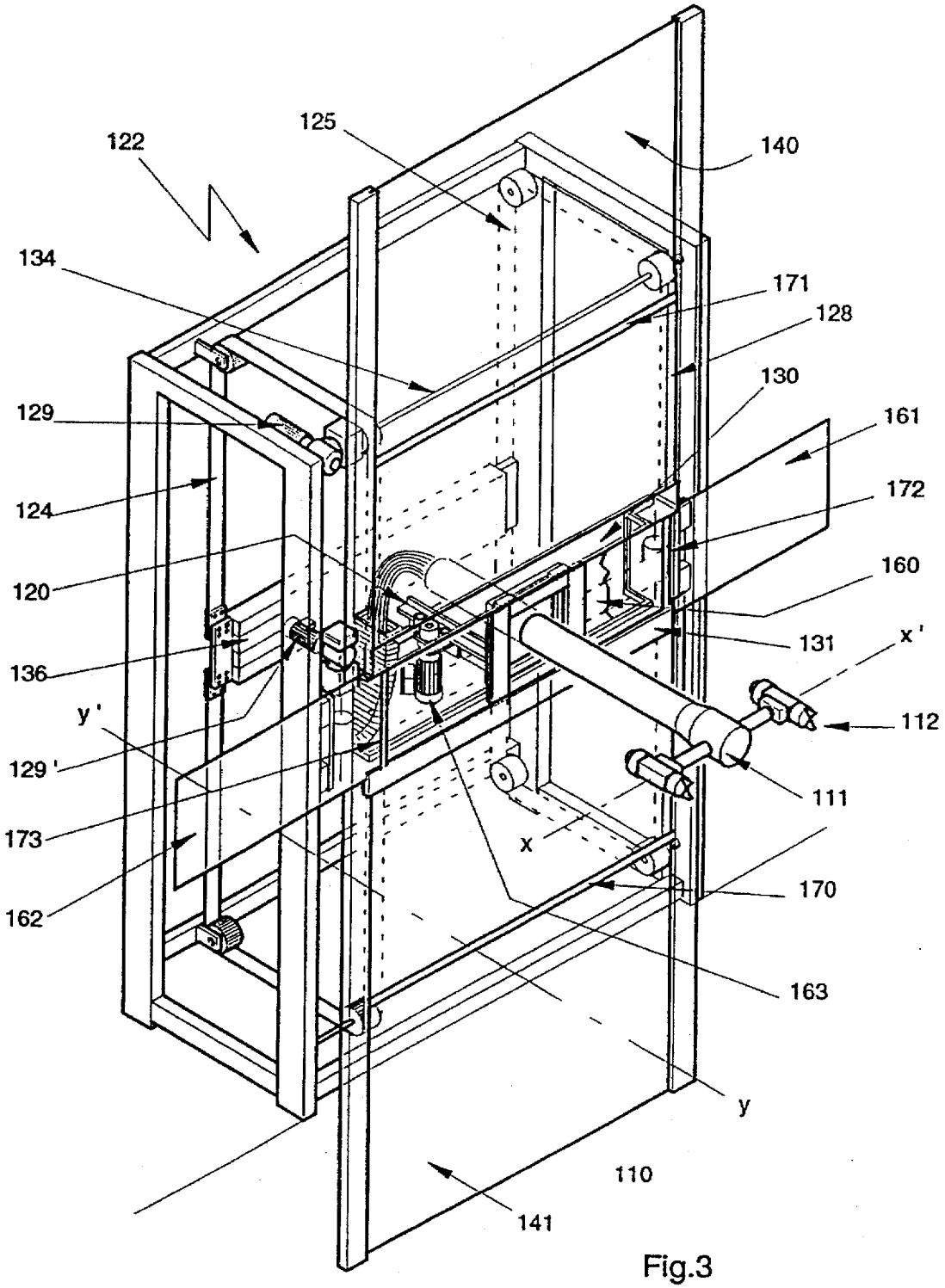
FIG. 3 is a diagrammatic perspective view of part of a lateral machine of the invention.

The gantry 122 of the lateral machine shown in FIG. 3 is also constructed in accordance with the invention. Parts corresponding to parts of the overhead machine shown in FIG. 2 are identified by the same reference numbers increased by 100. They will not be described in detail. They operate in a similar manner. An arm 111 carrying two pneumatic and for example electrostatic sprayers 112 is rotated about its major axis by a drive system (not shown) with a vertical movement and with a lateral tracking movement by belts 124, 125 and 160. It is also mobile in the depthwise direction by virtue of movement of the carriage 120 driven by the motor 163. The sprayers can be mobile about the axis XX'.

The panels 140 and 141 fixed to the belts 124 and 125 near the rails 130 and 131 are rigid. Corresponding locations are provided in the ceiling and in the floor of the installation to receive these panels during up and down movements of the arms 111. Locating the panels 140 and 141 exclusively in the plane of the front of the gantry 122 facilitates access to the interior of the latter.

The sealing panels 161 and 162 can also be installed in this way and enter corresponding lateral locations in the wall of the booth 110.

To enable an operator to monitor spraying visually the material of the sealing panels can be transparent: as these panels constitute the spray booth, the operator can see into the booth without entering it. It is sufficient for only one of these panels to be transparent.

Figure 4:
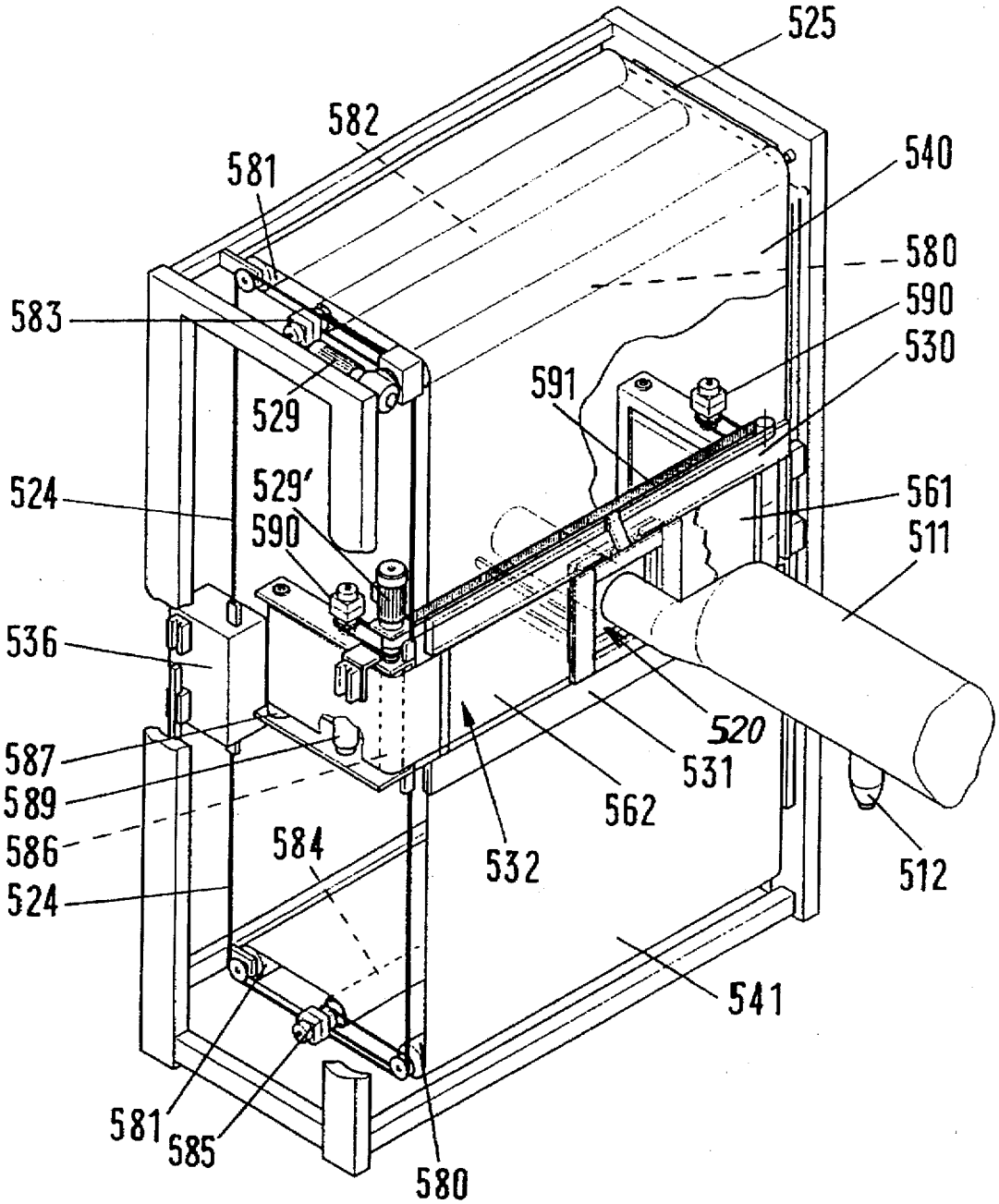
FIG. 4 is a diagrammatic view similar to FIG. 2 showing a variant gantry of an overhead machine of the invention.

FIG. 4 shows another overhead machine. In this embodiment of the invention structural parts similar to those of the FIG. 2 device are identified by the same reference numbers increased by 500. They will not be described in detail. First panels 540 and 541 and second panels 561 and 562 are constituted of strips of flexible material. Accordingly, each first panel 540, 541 comprises a flexible strip running over two guide rollers 580, 581 whose axes are parallel to the plane of the front of the gantry. One edge of the panel 540 is fixed to the rail 530 and its opposite edge or end is fixed to a driven roller 582. Driven by an electric motor 583, this roller is disposed parallel t0 and substantially between said guide rollers. Similarly, one edge of the panel 541 is fixed to the rail 531 and its opposite edge is fixed to a roller 584 driven by an electric motor 585. A comparable arrangement is provided for the second panels 561 and 562. Each second panel comprises a flexible strip running over two guide rollers 586, 587 on a mobile assembly 532 fastened to the carriage and movable vertically in the gantry by flexible coupling members 524, 525 (chains in this example) driven by the motor 529. The two guide rollers 586, 587 are disposed along one side of the gantry. The end of each second panel opposite the carriage is fixed to a driven roller 589. Driven by a motor 590 this roller is parallel to and between said guide rollers.

As in the previous two embodiments of the invention, the carriage is moved by flexible coupling members, in this example the spaced chains 524, 525, near the lateral ends of the gantry. Said second panels are moved by at least one flexible coupling member constituting movement transmission means mechanically disposed between a motor 529' and the carriage. In this example this flexible coupling member is a notched belt 591 fixed to the carriage.

It is clear from the above description with reference to FIG. 4 that the disposition of the first and second panels on rollers near the bottom and top of the gantry, on the one hand, and the sides of the gantry, on the other hand, provides free access to the rear of the machine, facilitating access to equipment inside the gantry. This access is further facilitated by the fact that the counterweight no longer extends the full width of the frame.

There is claimed:

1. A coating product sprayer machine constituting an overhead or lateral machine and comprising: at least one lateral gantry having a front provided with an opening; a support member carried by said gantry and carrying at least one sprayer mobile relative to objects to be coated, said support member being adjustable in position in said opening; at least one flexible coupling member coupled to said support member for moving said support member up and down in said opening; and at least one mobile sealing panel fixed to, and movable with, said flexible coupling member for closing off at least part of said opening.

2. Machine according to claim 1 for coating objects while the objects move along a path, wherein said gantry has at least one inside wall and said flexible coupling member comprises a drive belt which forms a closed loop and the closed loop extends along the inside wall.

3. Machine according to claim 1 wherein said at least one flexible coupling member comprises two drive belts which extend parallel to one another.

4. Machine according to claim 1 including panel cleaning means in contact with said panel and adapted to operate during spraying.

5. Machine according to claim 1 wherein said at least one mobile sealing panel is in contact with said at least one flexible coupling member.

6. Machine according to claim 1 wherein said support member has an upper edge and a lower edge and said at least one mobile sealing panel comprises two mobile sealing panels, one of which extends upwardly from the upper edge of said support member and the other of which extends downwardly from the lower edge of said support member, each of said two mobile sealing panels being fixed to, and movable with, said flexible coupling member.

7. Machine according to claim 1 wherein said at least one mobile sealing panel is disposed between said at least one sprayer and said at least one flexible coupling member.

8. Machine according to claim 1 wherein: said at least one sealing panel comprises two first mobile panels; and said machine further comprises two first sets of rollers, each first set guiding a respective first mobile panel and each first set comprising two guide rollers and one driven roller, said guide rollers and said driven roller being rotatable about mutually parallel axes of rotation and each said first mobile panel being guided over said rollers of its respective set.

9. Machine according to claim 8 further comprising two second mobile panels and two second sets of rollers each for guiding a respective second mobile panel, each second set of rollers comprising two guide rollers and one driven roller, said guide rollers and said driven roller being rotatable about mutually parallel axes of rotation and each said second mobile panel being guided over said rollers of its respective set.

10. Machine according to claim 1 wherein said panel is fixed removably to said flexible coupling member.

11. Machine according to claim 10 wherein said panel is fixed to said flexible coupling member so that it can be demounted from said device whilst said flexible coupling member remains in position.

12. Machine according to claim 1 wherein said panel is flexible in at least one direction.

13. Machine according to claim 12 further comprising battens which stiffen said panel and extend parallel to a winding axis of said drive belt.

14. Machine according to claim 1 wherein said panel enters a location formed in the ceiling, floor or wall of a spray booth.

15. Machine according to claim 3 wherein said panel is rigid.

* * * * *